US007340874B2

(12) United States Patent
Bechtold

(10) Patent No.: US 7,340,874 B2
(45) Date of Patent: Mar. 11, 2008

(54) HORSE HALTER

(76) Inventor: Karen Bechtold, 40 Hobamack Rd., Weymouth, MA (US) 02191

( * ) Notice: Subject to any disclaimer, the term of this patent is extended or adjusted under 35 U.S.C. 154(b) by 353 days.

(21) Appl. No.: 11/255,753

(22) Filed: Oct. 22, 2005

(65) Prior Publication Data

US 2007/0089380 A1 Apr. 26, 2007

(51) Int. Cl.
*B68B 1/02* (2006.01)

(52) U.S. Cl. ..... 54/24

(58) Field of Classification Search ..... 54/6.1, 54/6.2, 24, 85

See application file for complete search history.

(56) References Cited

U.S. PATENT DOCUMENTS 367,943 A * 8/1887 Whittemore ..... 54/24
417,638 A * 12/1889 Harmon ..... 54/24
1,325,061 A 12/1919 Veal
4,852,336 A * 8/1989 Gammill ..... 54/24
5,086,611 A 2/1992 Purdy
7,124,562 B2 * 10/2006 Blocker ..... 54/6.1

* cited by examiner

*Primary Examiner*—Rob Swiatek

(57) ABSTRACT

A halter, preferably for a horse, comprised of a crown strap (20), a throat latch (42) having one end which can be selectively detached from the crown strap (20), a pair of cheek straps (54) which connect the crown strap (20) to a chin strap (64) and a nose strap assembly (96), and that said nose strap assembly (96) is selectively detachable from the body of the halter to allow the halter to positioned on the horse's head without first removing the bridle and to allow the bridle to placed on the horse without first removing the halter.

5 Claims, 6 Drawing Sheets

HORSE HALTER

CROSS-REFERENCE TO RELATED APPLICATIONS

Not Applicable

FEDERALLY SPONSORED RESEARCH

Not Applicable

SEQUENCE LISTING OR PROGRAM

Not Applicable

BACKGROUND OF THE INVENTION

1. Field of Invention

This invention relates to an improved halter, preferably to be worn by a horse.

2. Prior Art

A halter is put upon a horse's head to control it while the horse is being lead or tied. Bridles have a mouthpiece and are used to ride or drive a horse. In order to put a bridle on a horse, the halter, if in place on the horse's head, must first be removed. This creates a chance for the horse to pull its head up out of the handler's reach so that it might run off. The same situation is created in reverse when the horse is wearing a bridle and the handler needs to put a halter on the horse.

There are two U.S. patents for halters that have addressed this problem, but neither has achieved commercial success in the United States. U.S. Pat. No. 5,086,611 to Purdy, 1989 solves the problem with a noseband strap that is attached to the rest of the halter at one or both ends with a snap. U.S. Pat. No. 1,325,061 to Veal, 1919 uses a single snap, with a different configuration of square-shaped rings to join the noseband strap and cheek pieces.

Both of these patents allow a handler to put a halter on a horse without removing the bridle first, or to put a bridle on without first removing the halter. However, both patents have flaws. The rings on both the Purdy patent and the Veal patent to which the noseband strap is attached allow the noseband strap to flop forward down over the horse's nose, since they are not are not confining enough to hold the snaps straight.

Most halters are made with slotted rings that are known as "squares." Squares have upper, middle and lower slots that are close to the same width as the nose and cheek strap material. The slots keep the noseband strap aligned correctly with the cheek straps. Adopting halter squares into the Purdy or Veal patent would not improve it. The snaps shown in both the Purdy and Veal patents cannot be used with squares, as the snaps cannot fit around the bar of the slot. Also, a metal snap attached to a metal ring would have a tendency to snap more easily than a strong, flexible material such as nylon or leather attached to a metal ring. The snaps may break if the horse pulls on the halter hard enough while attached to a restraining tether. In general, the snaps do not create a neat appearance on the horse, which may be why neither halter is in common use.

There is a halter in European countries that has been in common use for quite some time. It has a noseband strap made of two straps. Each of these straps is permanently attached at one end to the preferred slotted squares on both sides of the halter. The opposite end of one of the straps has a buckle attached to it and the other strap has holes to receive it. Thus, the noseband strap is made of two straps and is joined in the middle by a buckle across the horse's nose. While this type of halter solves the problem of leaving the horse's head free when changing its headgear, it has not proven popular with horse owners in the United States.

The skin across a horse's nose is thin and prone to damage. Horse owners in the U.S. often put fleece tubes on the noseband straps of their horse's halters to prevent sores. I believe American horse owners have not embraced the European design because the buckle, with the bar side toward the horse, lies squarely across the horse's nose or slightly off to one side. While the bar of the buckle is safely covered by the connecting strap, the buckle creates a hinge-like portion in the noseband strap. This probably makes horse owners think that the buckle will cause damage to their horse's nose.

In addition, the European style of halter usually does not offer a strap that can be shortened under a horse's chin to accommodate different sized noses. In the European style, it is the strap across the bridge of the nose that has the adjustment holes. If the noseband strap is shortened enough, a strap end that can flap about is created. The loose end can be tucked into the hole of the left halter square, however, doing so interferes with the common practice of running the chain end of a lead line up through the left halter square, looping it around the noseband strap or running it under the horse's chin, then through the right halter square and alongside the right cheek strap to be attached to the right ring by the horse's ear. This is done for added control of the animal.

OBJECTS AND ADVANTAGES

The objects of this invention are:

a) to provide a halter that is esthetically pleasing;

b) to provide a halter that can be put on a horse without the necessity of removing the horse's bridle, if in place, first;

c) to provide a halter that, if in place, can be removed from a horse after a bridle has been placed on the horse;

d) to provide a halter having a noseband strap that can be selectively disengaged or removed from the halter entirely;

e) to provide a halter that does not have loose straps that will interfere with the act of running the chain end of a lead line through the squares of the halter;

f) to provide a halter having a noseband strap that has the same strength of structure as a conventional halter;

g) to provide a halter that has a noseband strap that provides a smooth flexible surface, that is, free of protrusions, irregularities or metal parts to come into contact with a horse's nose.

Further objects and advantages are to provide a halter that can be manufactured from previously existing materials and hardware, which is inexpensive to manufacture, which is easy to use, and which can be made of different colors and materials. The noseband strap of the present invention offers the same smooth surface to come into contact with the horse's nose, as well as the structural strength of a noseband strap on a conventional halter.

The removable nature of the noseband strap on the present invention allows it to be used to replace the noseband strap of an existing halter, after which said halter will have the advantages of the present invention, without the need to replace the entire halter. The advantages of the present invention are not limited to those listed here.

SUMMARY

The present invention comprises a horse halter having a removable noseband strap that is attached on either end to the remainder of the halter by buckles, with the buckles facing upward and said noseband strap having a smooth, unbroken surface to come into direct contact with the horse's nose.

DRAWINGS—FIGURES

Figure 1:
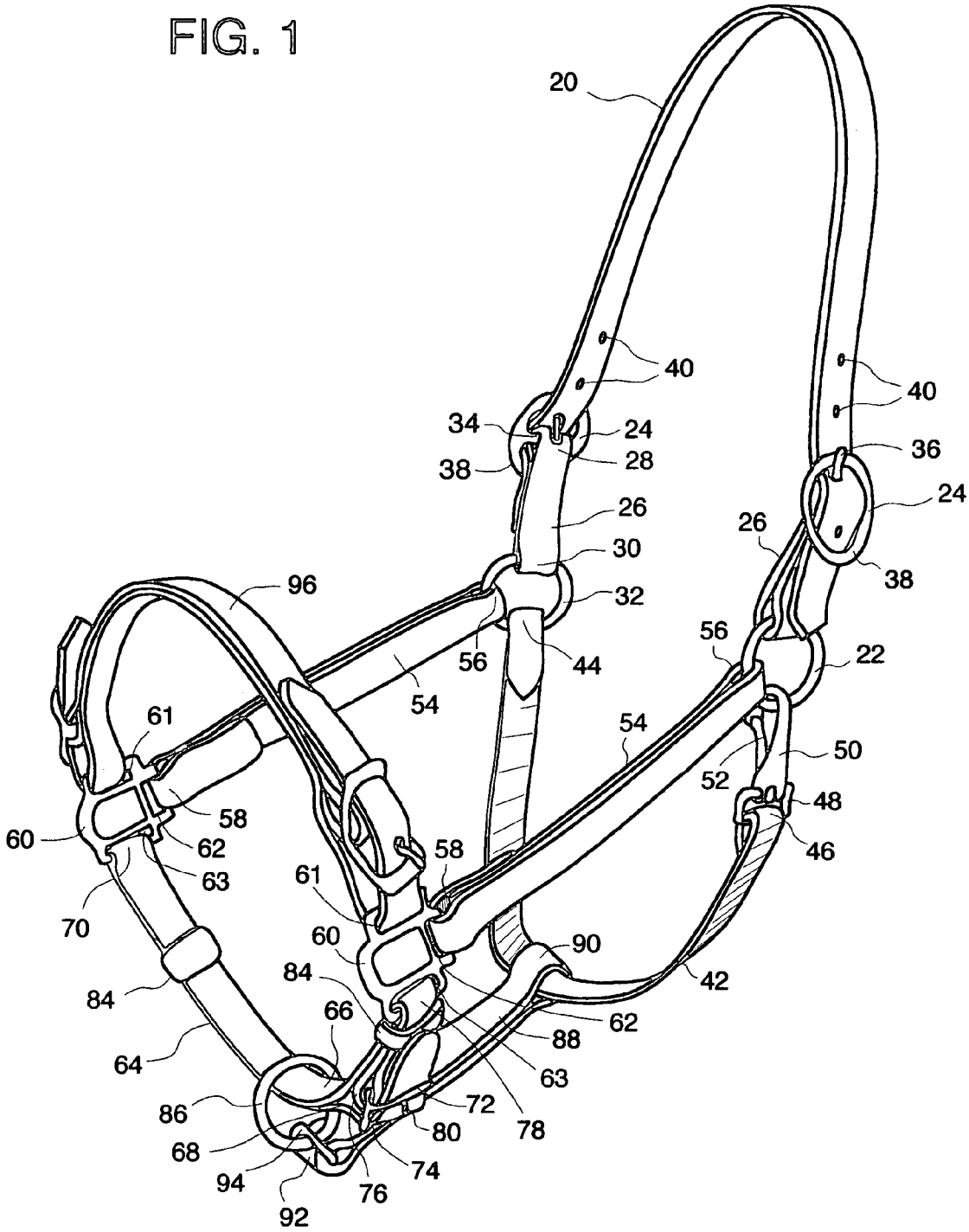
FIG. 1 is a perspective view of the entire halter.
Figure 2:
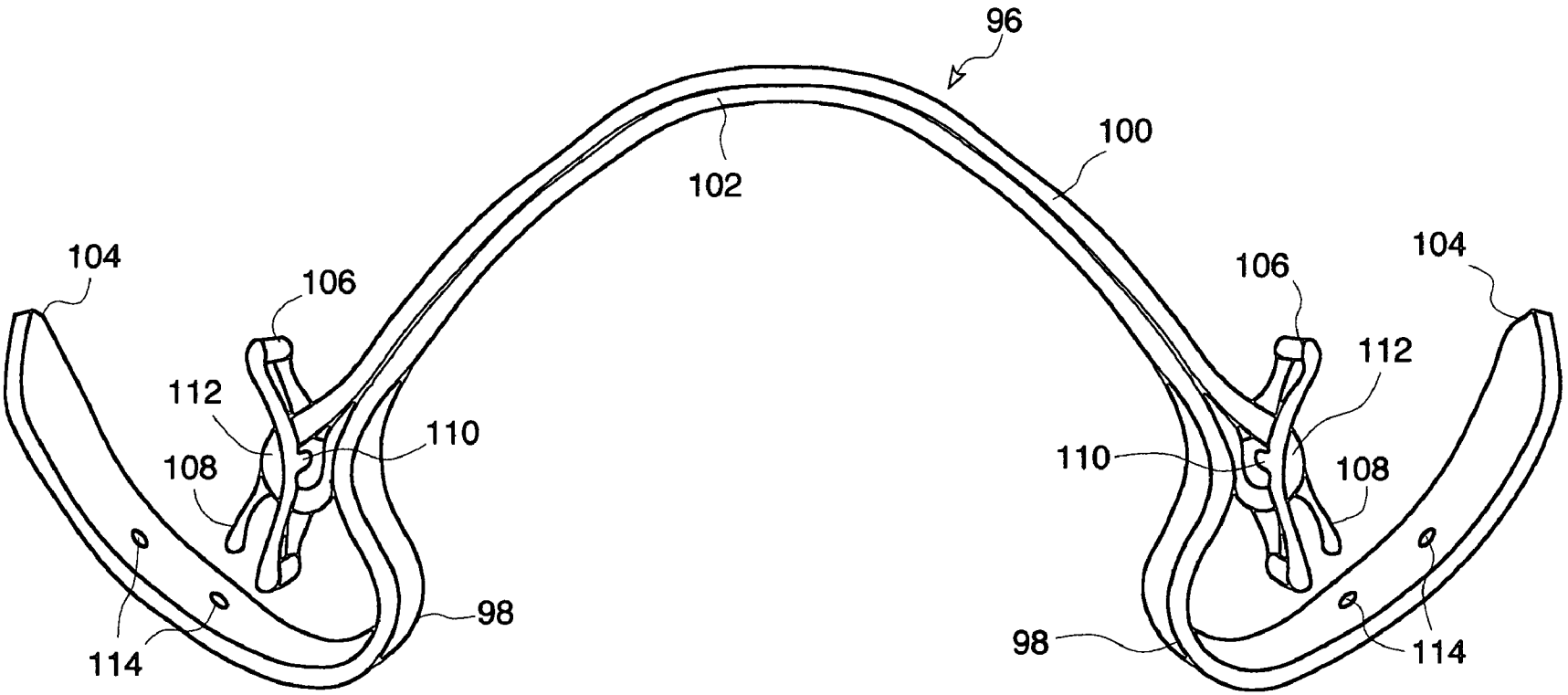
FIG. 2 is a partial perspective view of the noseband strap assembly of the preferred embodiment.

A preferred embodiment of the present invention is shown in FIG. 1 and in FIG. 2. All the straps are made of a material that is suitably strong and flexible to restrain a horse. Examples of suitable materials would be leather or nylon webbing, but other similar materials may be used. Stitching is used to construct the straps where they are shown to be a double layer of material.

FIG. 1 shows the improved halter which includes crown strap 20 that fits over the top of the horse's head behind his ears. One end of said crown strap 20 is fastened by means of buckle 24 to crown strap extension 26 which has a loop 30 slidably mounted on metal ring 32. The buckle bar 34 of buckle 24 is movably mounted within loop 28 of crown strap extension 26 and the buckle tongue 36 has one end pivotally mounted on buckle bar 34 and its opposite end rests on buckle ring 38 when it extends through one of the adjustment holes 40 of crown strap 20. The opposite end of the crown strap 20 is attached to ring 22 by means of a buckle 24 and a strap extension 26 in the same manner the first end of crown strap 20 is attached to ring 22.

A throatlatch strap 42 shown in FIG. 1 has an end which is formed into a loop 44 which is slidably mounted on ring 32. The opposite end of throatlatch strap 42 is formed into a loop 46 which receives the end 48 of snap latch 50, the opposite end of which is movably mounted on ring 22 in the conventional manner and is secured thereon by latch spring tongue 52. Thus, the throatlatch strap can be selectively detached from ring 22 as required.

A pair of cheek straps 54 shown in FIG. 1 have rearward ends formed into loops 56 which movably encircle rings 22 and 32. The forward ends of cheek straps 54 are formed into loops 58. A pair of slotted rings 60 having a top slot 61, a middle slot 62 and a bottom slot 63 are movably joined at their middle slots 62 with cheek strap loops 58.

A chin strap 64 for placement under the horse's chin is formed by one end of an elongated strap 68 forming a loop 76 which secures the central portion 74 of buckle 72 which is of the same type as buckle 24.This outer strap 68 continues from buckle 72 to form a loop 78 which passes through the bottom slot 63 of square 60 thereby becoming the inner portion 66 of chin strap 64. Inner portion 66 continues then forming a return bend 70 through the bottom slot 63 of its associated square 60 thereby becoming the remainder of outer portion 68. The end of outer strap portion 68 has a plurality of holes 80 which receive tongue 82 of buckle 72 to allow the length of the chin strap 64 to be adjusted. A pair of slidable loops 84 hold inner portion 66 of the chin strap in alignment with outer portion 68.

A ring 86 shown in FIG. 1 is located in encircling relationship to chin strap 64. A horizontal connector strap 88 has a loop 90 formed at one end which slidably receives the central portion of throatlatch strap 42. The opposite end of horizontal-connector strap 88 is formed into a loop 92 which receives ring 94 which is looped through ring 86. Thus, connector strap 88 is slidable along the length of throatlatch strap 42 and chin strap 64.

A noseband strap assembly 96 shown in FIG. 1 and shown in detail in FIG. 2 is detachably associated on either end to the upper slots 61 of squares 60 by means of loops 98 terminated by buckles 106 of-the same style as buckles 24 and 72. The noseband strap assembly 96 is comprised of two straps, a top strap 100 and a bottom strap 102. The top strap 100 has a loop 112 on both ends formed by turning the ends under, and a buckle 106 is mounted onto each loop 112 for detachably associating the ends of said top strap 100 with the ends of said bottom strap 102. The top strap 100 and buckles 106 are as a whole secured by means of stitching to the bottom strap 102 with an equal amount of the bottom strap ends 104 extending beyond both buckles 106 of the top strap 100. The bottom strap 102 has adjustment holes 114 to receive the tongue 108 of its associated buckle 106, thereby forming a loop 98 to receive the upper slot 61 of its associated square 60. The bottom strap 102 is made of a material that is sufficiently strong and resistant to stretching so that holes 114 do not stretch or fail entirely if the horse puts stress on the noseband strap 96, while still being flexible enough to be easily formed into loops 98.

Figure 3:
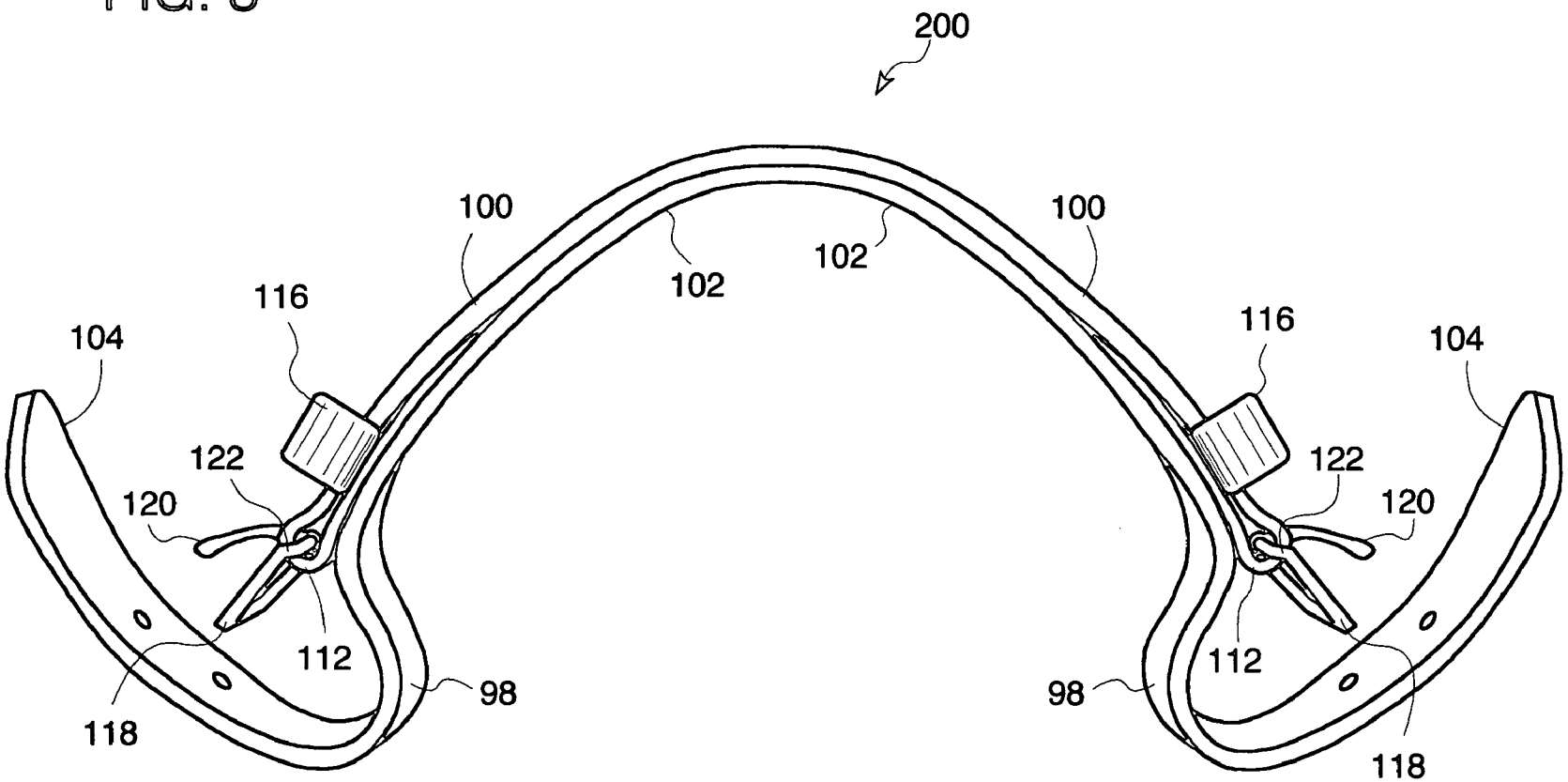
FIG. 3 is a partial perspective view of a first modified embodiment of the noseband strap assembly.

Operation—FIGS. 1, 2 and 3

The present invention is placed on a horse's head in the same manner a conventional halter would be. The horse's head is enveloped by it, with the crown strap 20 (FIG. 1) sitting behind the horse's ears, the cheek straps 54 alongside his face, and his nose encircled by the loop formed by the noseband strap 96 and chin strap 64. The chin ring 86 is used to attach a lead line to lead or secure the horse with.

When exchanging the horse's halter, constructed in the manner of the present invention, for a bridle, the bridle is put on with the bridle's throatlatch strap and noseband unbuckled. The bridle is slid up the horse's face starting at the horse's nose, with the mouthpiece, called a bit, being slid into the horse's mouth. The crown piece of the bridle is then drawn up and behind the horse's ears. As a whole, the bridle is placed directly over the halter.

The present halter's crown piece 20 should be pushed back from the ears toward the horse's back slightly to accommodate the crown piece of the bridle. The throatlatch strap 42 (FIG. 1) is unsnapped and the noseband strap 96 of the present halter is unbuckled on the side closest to the handler only, leaving the opposite end connected to its halter square 60. With the noseband strap 96 separated from the rest of the halter, the present halter can now be slid out from under the cheek pieces that secure the noseband and bit of the bridle. With a conventional halter this couldn't be done because the mouthpiece of the bridle, referred to as the bit, would prevent the removal of the halter.

To fully remove the present halter, one need only slide the crown piece 20 forward over the horse's ears and down alongside his face past the bit and the reins. The handler then secures the noseband and throatlatch strap of the bridle. The horse is now controlled with the reins, instead of the lead line attached to the halter.

To put on the halter and remove the bridle, the process is reversed. The noseband and throatlatch strap of the bridle are unbuckled. The present halter, with the noseband strap 96 and throatlatch strap 42 unbuckled, is slid up and over the horse's head. When positioning the halter, the crown strap 20 of the halter is placed so as to sit behind the crown strap of the bridle behind the horse's ears. The handler then runs the free end of the noseband strap 96 of the halter up under the cheek straps that secure the noseband and bit of the bridle, on one side of the horse's face. The halter's noseband strap 96 is then brought up over the horse's nose, then under the cheek straps securing the bridle's bit and noseband on the other side. It is then connected to the upper slot of the other square. The bridle is now positioned over the halter.

The handler can simply lift the crown strap of the bridle and bring it forward, clear of the horse's ears and away from his face. When the horse drops the bit out of his mouth, the bridle is completely free of his face. The present halter is then secured by attaching snap 50 (FIG. 1) of throatlatch strap 42 to ring 32.

Advantages

From the foregoing description, the following advantages are evident:

a) The materials used to construct the present invention are readily available.
b) The materials used to construct the present invention will not raise the cost of it above that of competing halter styles already in use.
c) The noseband strap of the present halter offers a smooth, unbroken surface to come into contact with a horse's nose.
d) The noseband strap will not damage the skin of a horse's nose.
e) The halter of the present invention can be easily exchanged for a bridle, or a bridle exchanged for the present halter without leaving the horse's head unrestrained at any time.
f) The noseband strap of the present invention has no loose ends that can interfere with the use of the halter, as the strap ends are short and tucked under the ring of buckle 106.
g) The noseband strap (FIG. 2) of the present invention can be sold separately and used to replace the noseband strap of a conventional halter, thereby affording the conventional halter the advantages of the present invention, without the user having to purchase an entire halter.

FIGS. 3, 4, 5 and 6—Alternative Embodiments

In FIG. 3 a first modified embodiment of the present invention is disclosed. All parts of this embodiment are identical to the previously described embodiment except for the buckles 118 securing noseband strap 200 to the upper slots 61 of slotted rings 60 and the addition of a keeper 116. All identical parts are either not numbered or carry the same numerals.

The buckles 106 (FIG. 2) of the preferred embodiment have a center bar 110 in an oval or square-shaped ring. The end of strap 104 is tucked under the ring of the buckle. The buckles 118 on the modified embodiment (FIG. 3) are known as end bar buckles. End bar buckles lack the oval or square shape with the bar in the middle. They are instead half of the oval or square shape with the bar 122 on one end. This means they require a loop to be sewn just behind the buckle known as a "keeper" 116. In use, end 104 is secured by the tongue 120 and is tucked under the keeper 116. The keeper 116 is used to keep strap end 104 from flapping about.

The center bar buckle 106 (FIG. 2) is preferable to the end bar buckle 118 (FIG. 3) because it creates less bulk when stitched onto the end of its receiving loop 112. The keeper 116 on end bar buckle 118 creates another layer of material that must be sandwiched into the stitching, adding more work to assemble, and a slightly less neat appearance. It is, however, another possible configuration of noseband strap 96.

Figure 4:
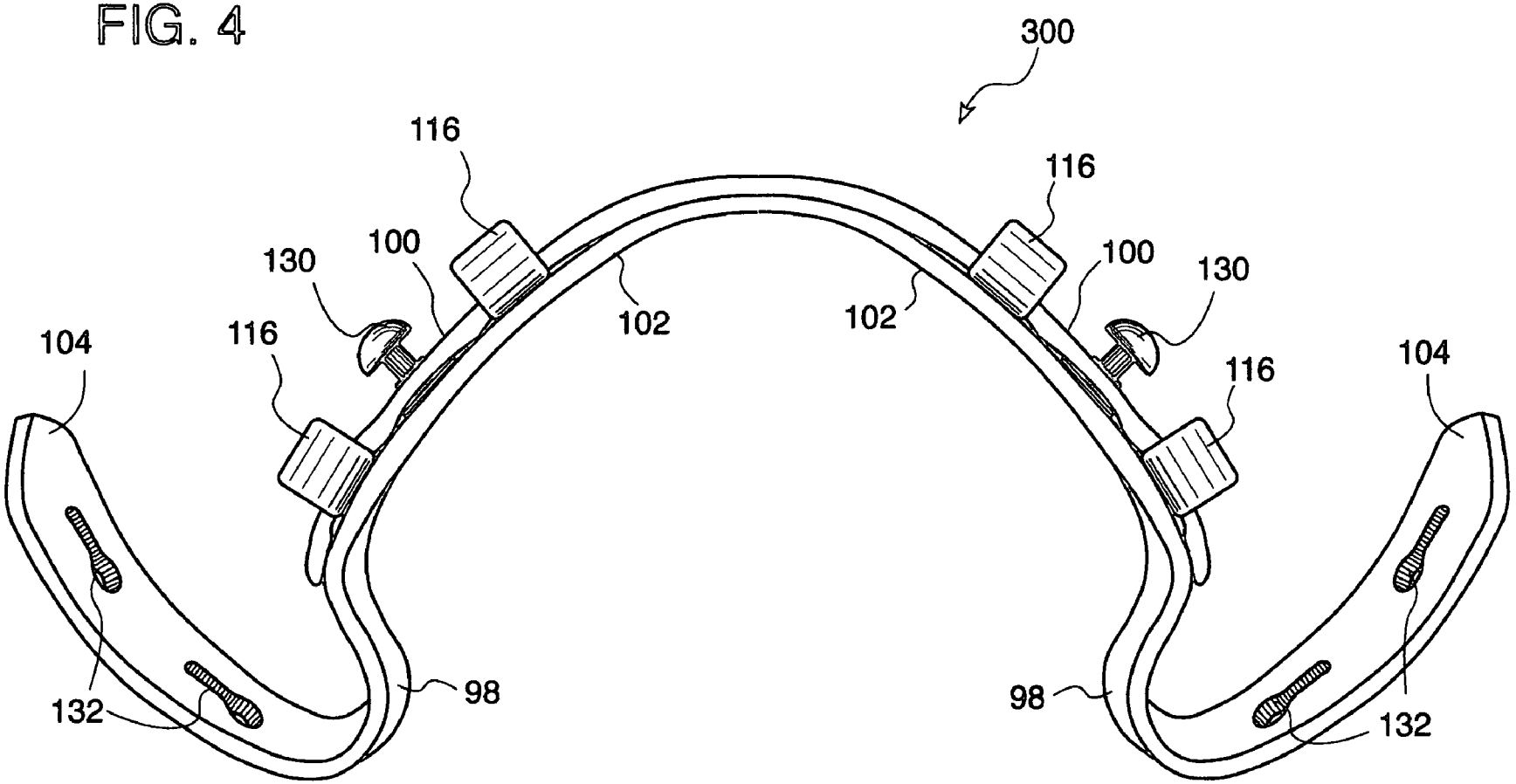
FIG. 4 is a partial perspective view of a second modified embodiment of the noseband strap assembly.
Figure 5:
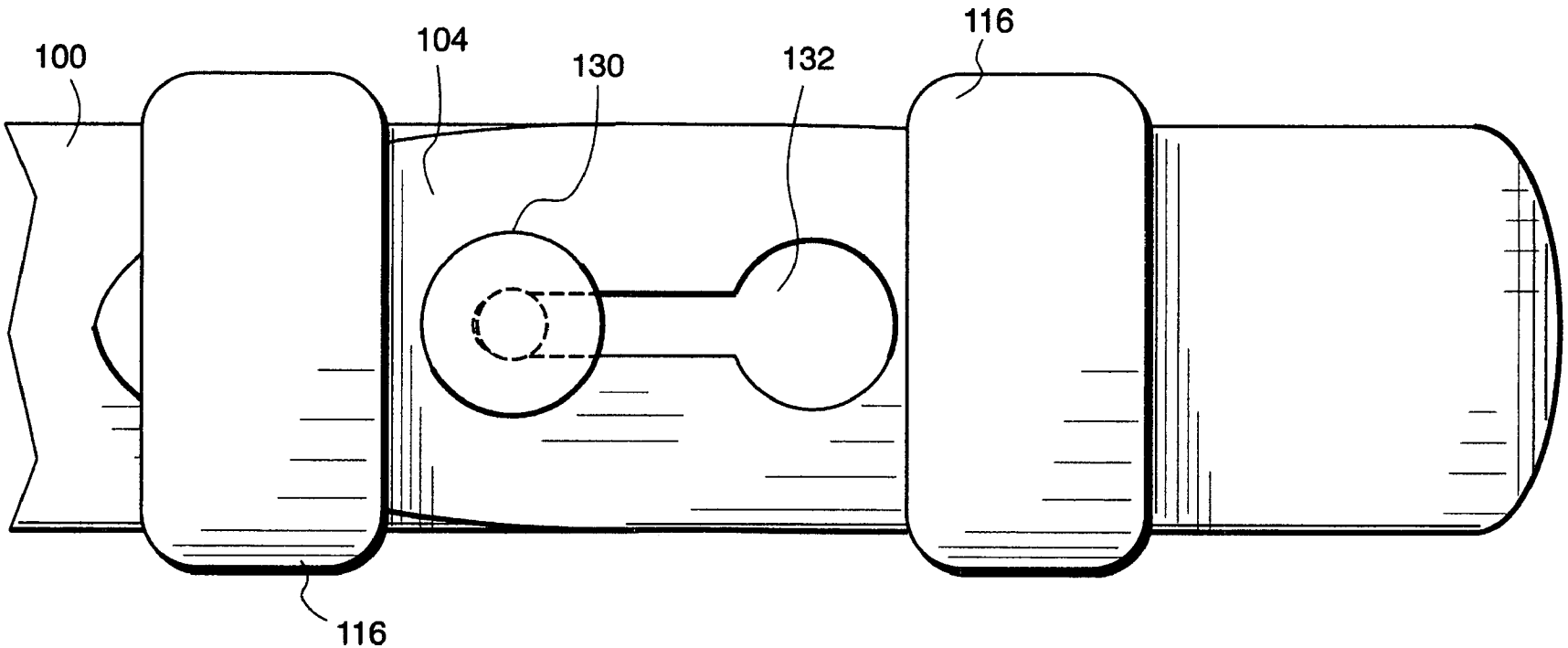
FIG. 5 is a top view of the second modified embodiment of the noseband strap assembly shown in FIG. 4 and of a third modified embodiment of the noseband strap assembly shown in FIG. 6.

In FIG. 4 and in FIG. 5 a second modified embodiment of the present invention is disclosed. The noseband strap assembly 300 of this embodiment uses stud closures 130 for detachably associating the ends of said top strap 100 with the ends of said bottom-strap 102 by securing keyhole-shaped holes 132 on ends 104 thereby forming loop 98, in place of buckles 106 and standard holes 114 as shown in FIG. 2. All identical parts to those shown in FIG. 2 are either not numbered or carry the same numerals as those shown in FIG. 2.

In this second modified embodiment (FIG. 4) stud closures 130 are positioned through top strap 100 from the upper side, each stud closure 130 being spaced close to each end of top strap 100 and secured on the underside of top strap 100 by means of a rivet-type element. A loop, referred to as a keeper 116, is positioned between each stud closure 130 and end 104 of top strap 100. Bottom strap 102 is attached to the bottom side of top strap 100 in a lengthwise manner. Thus, keepers 116 and the securing elements of stud closures 130 are held between top strap 100 and bottom strap 102, thereby presenting a smooth, continuous surface to come into contact with a horse's nose.

In addition, two ways of constructing a stud closure version of the noseband strap assembly are possible. The first is shown in (FIG. 4) version 300, wherein the top strap is shorter in length and centered on the bottom strap, with the bottom strap being of a sufficient thickness to prevent it from stretching or the holes 132 from tearing should the horse apply pressure to the noseband. A second possible construction is to have the top 100 strap and bottom strap 102 be equal in length as shown in noseband strap assembly 400 shown in FIG. 6. In this construction the holes 132 of ends 104 are of a double thickness and less likely to stretch on the stud closures 130, however the double thickness may make the ends 104 of the noseband strap assembly less flexible, thus it might be more difficult to bend the strap to form loop 98 and to push the holes 132 down over stud closure 130.

Figure 6:
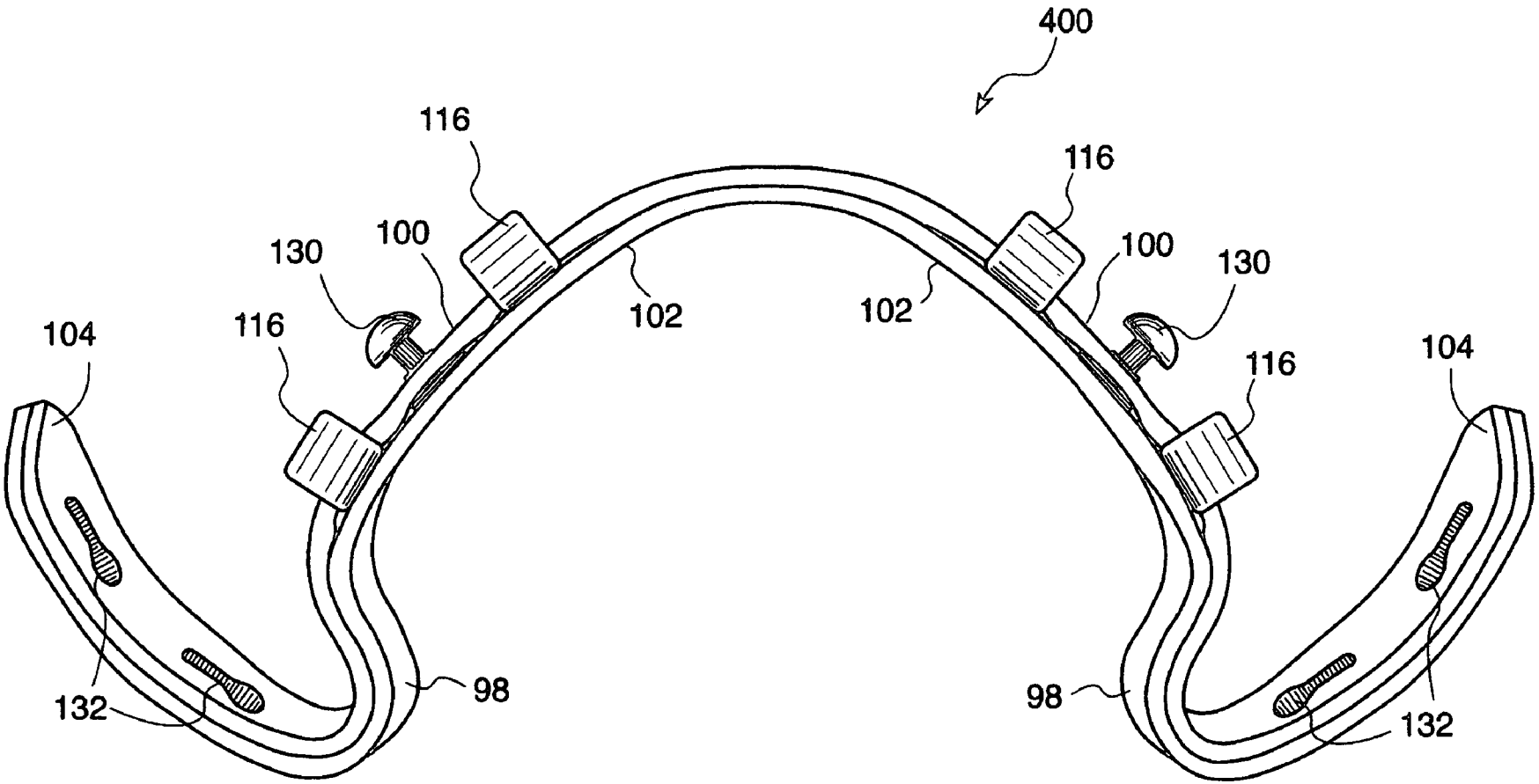
FIG. 6 is a partial perspective view of a third modified embodiment of the noseband strap assembly.

Operation—FIGS. 4, 5 and 6

In operation, ends 104 are fed through the upper slots 61 of slotted rings 60 and then brought up through keepers 116 forming loops 98. Ends 104 are drawn through keepers 116 until the round part of holes 132 are positioned over stud closures 130. Ends 104 are then pushed down over stud closures 130 so that holes 132 slide down over stud closures 130. Tension is put on each end 104 by grasping one of the slotted rings 60 in one hand and the middle part of noseband strap 96 in the other, then pulling in opposite directions. This forces end 104 straps to slide toward stud closures 130 until the narrow, elongated part of holes 132 are secured under stud closures 130. Keepers 116 keep ends 104 from popping up off stud closures 130.

To release either loop 98, ends 104 must be released from stud closure 130. To do this, the fingers of one hand are used to support loop 98 on one end of noseband 300 while the thumb of the same hand pushes end 104 toward stud closure 130 until the round part of hole 132 surrounds stud closure 130. End 104 can now be brought up off stud closure 130. End 104 is then passed back out through keeper 116.

This arrangement using stud closures 130 FIG. 4 and FIG. 6 is a possible configuration because it offers a noseband with a neat appearance and a smooth underside. I have not chosen it as my preferred embodiment because I feel that buckles 106 (FIG. 2) are more secure, easier to use and easier to incorporate into the manufacturing of a halter.

A possible embodiment of chin strap 64 (not shown) would be to have two straps, each connected at one of their ends to the bottom slot of one of the slotted rings, and the other of their ends being connected to and therefore joined by a ring. The connecting strap 88 would also be joined directly to this ring in this arrangement. Thus, the chin and connector straps 88 would form a T under the horse's chin and jaw line, with the trunk of the T connecting to the throatlatch strap 42. There is no appreciable advantage to this arrangement, but it is in common use, and so it is mentioned here.

CONCLUSION, RAMIFICATIONS, AND SCOPE

The reader will see, after examining the structure of this halter, that the present halter is a simple and easily used adaptation of the conventional design. It can be constructed entirely of materials already well-known and available to the horse industry. If it is made of nylon, the halter can be made in any color. In addition, it fulfills the main object of being able to be removed from or put on a horse under a bridle.

The above description shows many specific parts and constructions, but these should not be seen as limiting the scope of the present invention. The illustrations and descriptions only describe the presently preferred embodiments of this invention. For instance, the snaps and buckles can be replaced by other types of closures. Thus the scope of this invention should be determined by the claims listed herein, and not by the examples provided.

I claim:

1. A halter for horses comprising:

a) a crown strap having a round ring at each of its opposite ends, first means for adjusting the length of said crown strap mounted onto said crown strap, b) a throatlatch strap having first and second ends, said throatlatch strap being permanently joined at said first end with one of said round rings, c) second means mounted onto said second end of throatlatch strap for selectively detaching said second end of said throatlatch strap to the other of said rings, d) a pair of cheek straps having rearward and forward ends, said cheek straps being joined to said round rings at their rearward ends, e) a pair of slotted rings, each said slotted ring having a bottom slot, a top slot and a middle slot, each said slotted ring being joined at said middle slot to said forward end of one of said cheek straps, f) a chin strap assembly joined at each of its opposite ends with said bottom slot of one of said slotted rings, g) a connecting strap having rearward and forward ends, said connecting strap slidably associated at said rearward end of said connecting strap with said throatlatch strap, h) third means mounted onto said forward end of said connecting strap for slidably associating said forward end of said connecting strap with said chinstrap assembly, i) a noseband strap assembly detachably joined at each of its opposite ends with said top slot of one of said slotted rings, said noseband strap assembly comprising a top strap, a bottom strap, said top and bottom straps having opposite ends and being joined together in a lengthwise manner, fourth means mounted at said opposite ends of said top strap for detachably associating the ends of said top strap with the ends of said bottom strap thereby forming a releasable loop, said fourth means being held between the lengths of said top and said bottom strap, said bottom strap being sufficiently greater in length than said top strap to form said releasable loop, said bottom strap having a plurality of holes to receive said fourth means mounted on the opposite ends of said top strap, whereby a halter having a noseband strap that can be detached wholly or in part from the slotted rings of the halter, stays positioned at approximately right angles to said cheek straps on a horse's nose and presents a smooth surface that is free of protrusions or metal parts that come into contact with a horse's nose is provided.

2. A halter of claim 1 wherein said fourth means for associating said ends of said top strap of said noseband strap assembly with said ends of said bottom strap includes a center bar buckle mounted onto each end of said top strap with said center bar buckles being held between top and bottom straps thereby providing a halter having a noseband assembly that is both detachable and presents a smooth, uninterrupted surface to come into contact with a horse's nose.

3. A halter of claim 1 wherein said fourth means for associating said ends of said top strap of said noseband strap assembly with said ends of said bottom strap includes an end bar buckle mounted onto each end of said top strap with a loop of strap material to hold the excess strap end positioned around said top strap behind each said end bar buckle with said end bar buckles and loops of strap material being held between top and bottom straps thereby providing a halter having a noseband that is both detachable and presents a smooth, uninterrupted surface to come into contact with a horse's nose.

4. A halter of claim 1 wherein said fourth means for associating said ends of said top strap of said noseband strap assembly with said ends of said bottom strap includes a stud fastener positioned at each opposite end of said top strap, each said stud fastener being passed through said top strap from its upper side and secured to said top strap by a fastening element on the underside of said top strap, a loop made of strap material placed around said top strap on either side of said stud fasteners positioned at opposite ends of said top strap, said fastening elements and loops of material being held between said top and said bottom straps, thereby providing a halter having a noseband strap assembly that is both detachable and presents a smooth, uninterrupted surface to come into contact with a horse's nose.

5. A halter for horses comprising:

a) a crown strap having a round ring at each of its opposite ends, first means for adjusting the length of said crown strap mounted onto said crown strap, b) a throatlatch strap having first and second ends, said throatlatch strap being permanently joined at said first end with one of said round rings, c) second means mounted onto said second end of throatlatch strap for selectively detaching said second end of said throatlatch strap to the other of said rings, d) a pair of cheek straps having rearward and forward ends, said cheek straps being joined to said round rings at their rearward ends, e) a pair of slotted rings, each said slotted ring having a bottom slot, a top slot and a middle slot, each said slotted ring being joined at said middle slot to said forward end of one of said cheek straps, f) a chin strap assembly joined at each of its opposite ends with said bottom slot of one of said slotted rings, g) a connecting strap having rearward and forward ends, said connecting strap slidably associated at said rearward end of said connecting strap with said throatlatch strap, h) third means mounted onto said forward end of said connecting strap for slidably associating said forward end of said connecting strap with said chinstrap assembly, i) a noseband strap assembly detachably joined at each of its opposite ends with said top slot of one of said slotted rings, said nose strap assembly comprising a top strap, a pair of stud fasteners, each said stud fastener being positioned through said top strap from the top side of said top strap near each opposite end of said top strap and being secured to the top strap by means of a connecting element positioned on the underside of said top strap, four loops of strap material positioned around said top strap such that each said stud fastener is positioned between a pair of said loops of strap material on said top strap, a bottom strap being of the same length as said top strap, said top and bottom straps being joined together along their full lengths, thereby securing said connecting elements of said stud fasteners and said loops of strap material between said top and bottom straps, a plurality of holes at each opposite end of said nose strap assembly for the purpose of accepting said stud fasteners, the placement of said stud fasteners on said top strap being conducive to allow said stud fasteners to accept said plurality of holes, thus forming a loop at each opposite end of said top strap, thereby providing a halter with a noseband strap that is detachable and presents a smooth, uninterrupted surface to come into contact with a horse's nose.

* * * * *